US011247210B2

(12) United States Patent
Appel et al.

(10) Patent No.: US 11,247,210 B2
(45) Date of Patent: Feb. 15, 2022

(54) TEMPERING BLOCK MODULE AND APPARATUS FOR THE THERMAL TREATMENT OF SAMPLES

(71) Applicant: Biometra GmbH, Göttingen (DE)

(72) Inventors: Eggert Appel, Adelebsen (DE); Janek Junghans, Göttingen (DE); Konstantin Missal, Kassel (DE)

(73) Assignee: Biometra GmbH, Göttingen (DE)

( * ) Notice: Subject to any disclaimer, the term of this patent is extended or adjusted under 35 U.S.C. 154(b) by 103 days.

(21) Appl. No.: 16/591,271

(22) Filed: Oct. 2, 2019

(65) Prior Publication Data

US 2020/0101459 A1 Apr. 2, 2020

(30) Foreign Application Priority Data

Oct. 2, 2018 (DE) ..... 10 2018 124 412.6

(51) Int. Cl.
*B01L 3/00* (2006.01)
*B01L 9/00* (2006.01)

(52) U.S. Cl.
CPC ..... *B01L 3/50851* (2013.01); *B01L 9/523* (2013.01); *B01L 2200/04* (2013.01); *B01L 2300/0829* (2013.01)

(58) Field of Classification Search
None
See application file for complete search history.

(56) References Cited

U.S. PATENT DOCUMENTS 6,153,426 A * 11/2000 Heimberg ..... B01L 3/50851 435/287.2
6,197,572 B1 * 3/2001 Schneebeli ..... B01L 3/50851 435/286.2
2018/0360023 A1 * 12/2018 McPherson ..... A01N 1/0252

FOREIGN PATENT DOCUMENTS

| | | | |
|---|---|---|---|
| CN | 106536371 | A | 3/2017 |
| DE | 10115848 | A1 | 10/2002 |
| DE | 69826834 | T2 | 12/2005 |
| JP | 2001149801 | A | 6/2001 |
| WO | 02078849 | A1 | 10/2002 |
| WO | 2017048987 | A1 | 3/2017 |

OTHER PUBLICATIONS

English language machine translation of DE10115848A1 (accessed Mar. 13, 2021), pp. 1-13. (Year: 2021).*

* cited by examiner

*Primary Examiner* — William H. Beisner
(74) *Attorney, Agent, or Firm* — Christopher R. Powers; Endress+Hauser (USA) Holding Inc.

(57) ABSTRACT

The present disclosure relates to a tempering block module for the thermal treatment of samples, comprising: a tempering block; and an ejection mechanism for lifting reaction vessels off the tempering block, the ejection mechanism including first and second ejection plungers that are movably mounted in the tempering block module perpendicular to the tempering block from a first position, retracted into the tempering block module, into a second position, extended out of the tempering block module, and wherein the tempering block module includes a first plunger drive connected to the first ejection plunger for driving the movement of the first ejection plunger and a second plunger drive, different from the first plunger drive, connected to the second ejection plunger for driving the movement of the second ejection (Continued)

plunger from the first to the second position or from the second to the first position.

16 Claims, 8 Drawing Sheets

TEMPERING BLOCK MODULE AND APPARATUS FOR THE THERMAL TREATMENT OF SAMPLES

CROSS-REFERENCE TO RELATED APPLICATION

The present application is related to and claims the priority benefit of German Patent Application No. 10 2018 124 412.6, filed on Oct. 2, 2018, the entire contents of which are incorporated herein by reference.

TECHNICAL FIELD

The present disclosure relates to a tempering block module, especially for a device for the thermal treatment of samples. The present disclosure further relates to a device for the thermal treatment of samples and to a method for removing a microtiter plate placed on a tempering block with a plurality of reaction vessels from a device for the thermal treatment of samples.

Such a device can be a thermocycler, for example. Such devices are used to expose samples to a predetermined temperature profile, for example for incubation or for carrying out the polymerase chain reaction (PCR), which generally takes place in a plurality of cycles in which the samples are first heated with DNA polymerase and then cooled again. A tempering block of such a device can include a plurality of receptacles for reaction vessels. These receptacles can be designed as depressions in a surface of the tempering block. The reaction vessels can be designed as receptacles formed in a microtiter plate, for example in the form of microwells. The microwells can be formed, for example, as recesses of the microtiter plate, which can engage in corresponding receptacles in the tempering block when the microtiter plate is placed on the tempering block. However, there are also microtiter plates, for example the so-called 1536 microtiter plates, in which the reaction vessels are formed by a honeycomb structure on a planar base surface. To control the temperature of samples present in such microtiter plates, a tempering block having a planar surface is used, which on the rear bears against the base surface of the microtiter plate when the microtiter plate is placed on the tempering block. Thermocyclers exist which are designed to press reaction vessels by way of a cover in firm thermal contact with the tempering block. For this purpose, a pressing force must be applied against the cover. For in-situ PCR or hybridization, specimen slides are known, in which the sample is applied to a surface region surrounded by a respective enclosure. Such samples applied to specimen slides can likewise be thermally treated in thermocyclers.

Individual reaction vessels or microtiter plates with a plurality of reaction vessels which can be used in thermocyclers frequently consist of a plastic. When reactions are carried out at comparatively high temperatures, the microtiter plates used in contact with the tempering block can adhere to the tempering block ("bake on") so that subsequently they can only be detached again from the tempering block against a certain resistance. This attachment to the tempering block may result in errors or malfunctions, especially in automated processes in which such containers are not brought into their operating position on the tempering block manually but by an automated gripper arm and are also removed from the device. If the adhered microtiter plate becomes detached with a jerk from the tempering block while being lifted out manually or by the gripper arm or only at individual points, sample liquid may be lost: When using open reaction vessels, the sample liquid may be spilled. If the microtiter plate is covered by sealing foil or a sealing mat (Engl. technical term: sealing mat), the vibration of the microtiter plate while removing the liquid may cause liquid to reach the sealing foil or the sealing mat and accumulate there as droplets so that it is lost for the further use of samples. In rare cases, the microtiter plate may be catapulted out of the device by the sudden release of the tempering block and may fall down.

In view of this problem, various ejection mechanisms have become known in the prior art which are intended to assist in lifting out reaction vessels in the form of sample plates from the temperature control block.

WO 02/078849 A1 describes, for example, an automatically operable thermocycler which has an ejection mechanism for a microtiter plate. The ejection mechanism comprises four ejection elements which can be moved between a rest position and an ejection position and are prestressed in the direction of their rest position. When a rectangular microtiter plate is used in the thermocycler, the ejection elements are arranged at their four corners below an edge region of the microtiter plate. In order to move the ejection elements from their rest position into the ejection position, an ejector slider is moved from a first to a second displacement position by a rotational movement of a rocker arm and thus causes an upward movement of the ejection elements into the ejection position against the prestressing of the ejection elements. During this movement, the ejection members strike against an edge surface of the microtiter plate and lift it out of the tempering block. The movement of the rocker arm is driven by a shaft coupled to the rocker arm via a rocker arm support by means of an electric motor. The electric motor simultaneously drives a pivoting movement of the cover of the thermocycler from a closed position into an open position via the rotational movement of the shaft so that the microtiter plate is lifted out of the tempering block by means of the ejection elements during the lifting movement of the cover.

Although this device functions very satisfactorily, it is nevertheless of complicated construction and is therefore expensive to manufacture. In addition, all ejection elements must be moved simultaneously with the cover. The ejection elements are always moved simultaneously, synchronously and with the same driving force; the movements of the ejection elements are therefore not individually controllable. The force exerted on the microtiter plate by the individual ejection elements is determined by their prestress and the dimensions of the ejection sliders or ejection elements. If reaction vessels stubbornly adhere to the thermocycler, the undesired effects described above cannot always be reliably prevented.

A device is also known from WO 2017/048987 A1 for the thermal treatment of samples which has a tempering block module with an ejection mechanism. The tempering block module is arranged in a base unit of the device which can be closed by a cover. The ejection mechanism comprises several ejection elements which are coupled to a receiving area ("drip pan") of the tempering block module via springs. A cuboidal tempering block is arranged on the tempering block module and is set up to support a microtiter plate. The ejection elements are arranged along the sides of the tempering block in a peripheral area of the receiving area surrounding the tempering block. When a microtiter plate is inserted into the tempering block, its peripheral area strikes against the ejection elements so that when the cover is closed, the microtiter plate pressed against the thermoblock by the cover moves the ejection elements downwards against the spring force. In this way, the microtiter plate is tensioned against the cover by the ejection elements. When the cover is removed after thermal treatment, the springs relax and lift the microtiter plate. This mechanism is comparatively simple in design, but involves risks during operation of the device. If, for example, the microtiter plate is strongly or only partially adhered to the tempering block, the plate can be lifted in an uncontrolled manner when the springs are released, especially suddenly, with the undesired effects described above. An additional disadvantage is that the spring forces of the ejection elements must be overcome when closing the cover. Thus, the pressure force with which the cover is pressed against the reaction vessels in the closed state cannot be precisely adjusted, since the spring forces are unknown or may change over time.

SUMMARY

It is the object of the present disclosure to provide a device for the thermal treatment of samples which permits a safe, especially automated, removal of sample vessels from the device after thermal treatment.

This object is achieved by the tempering block module in accordance with claim 1 and by the device in accordance with claim 7. The present disclosure also comprises a method for removing reaction vessels from a device for the thermal treatment of samples in accordance with claim 15. Advantageous embodiments are listed in the dependent claims.

The temperature control block module in accordance with the present disclosure, which is suitable for use in a device for the thermal treatment of samples, comprises:

a tempering block and an ejection mechanism which is used to lift reaction vessels placed on the tempering block from the tempering block, wherein the ejection mechanism comprises at least one first ejection plunger and one second ejection plunger, wherein the first and the second ejection plunger is mounted in the tempering block module so it can move perpendicularly to a plane in which the tempering block is arranged from a first position (rest position) which is retracted into the tempering block module into a second position (ejection position) which is moved out of the tempering block module, and wherein the tempering block module also comprises a first plunger drive operatively connected to the first ejection plunger for driving the movement of the first ejection plunger from the first to the second position, or from the second to the first position, and wherein the tempering block module comprises a second plunger drive different from the first plunger drive that is operatively connected to the second ejection plunger for driving the movement of the second ejection plunger from the first to the second position or from the second to the first position.

The reaction vessels that can be used with the tempering block module can be formed in a microtiter plate. This can have, for example, a plurality of depressions serving as reaction vessels. The microtiter plate can also have a flat rear side, wherein the reaction vessels are formed by a structuring on their front side.

In one possible embodiment, the tempering block can include a plurality of receptacles for one or more reaction vessels. A microtiter plate with plurality of depressions serving as reaction vessels can be placed on such a tempering block during operation of the tempering block module in such a way that the individual depressions each engage in a receptacle of the tempering block. Alternatively, the tempering block can have an essentially flat surface. In this case, a microtiter plate having a flat rear side can be placed on the surface of the tempering block during operation of the tempering block module.

By moving the first and second ejection plungers by means of different plunger drives, the movements of the ejection plungers can be driven with different force, different speed and/or at different times independently of one another and thus also individually controlled. The path length of the ejection movement can likewise be predetermined by the plunger drives, especially individually for each ejection plunger, by stopping the ejection movement before reaching the second position. This ensures a substantially higher flexibility of the ejection movement of the microtiter plate compared to the solutions known from the prior art. For example, different boundary conditions predetermined by the automatic operation of the device can be taken into account.

In an advantageous embodiment of the tempering block module, this can comprise a plurality of ejection plungers which are movable between the first and the second position, wherein the tempering block module has one plunger drive per ejection plunger in such a way that each plunger drive is operatively connected to one of the ejection plungers for driving the movement of the ejection plunger from the first into the second position and/or from the second into the first position. The number of ejection plungers can be even or odd; for example, three, four or six ejection plungers are advantageous.

The ejection plungers may be arranged at a periphery of the tempering block. Periphery means an area extending around the edge of the tempering block, the width of which is dimensioned so that the ejection plungers are arranged in relation to a microtiter plate intended for the application so that the ejection plungers, in the extended position, strike a lower peripheral area of the microtiter plate or a frame surrounding the microtiter plate from below. In the case of a tempering block with a rectangular cross-section, it is advantageous if the ejection plungers are arranged at the four corners of this cross-section. Alternatively, the ejection plungers can also be arranged in pairs on opposite sides of the tempering block. Advantageously, the ejection plungers are arranged in such a way that during operation, i.e. when a microtiter plate is inserted into the tempering block, they are located underneath a peripheral area of the microtiter plate that does not comprise reaction vessels. In principle, however, it is also possible to provide the microtiter plate with an adapter in the form of a frame surrounding the microtiter plate, the circumference of which is dimensioned so that the ejection plungers are located under the adapter when the microtiter plate equipped with an adapter is inserted in the tempering block.

In addition to the tempering block, the tempering block module can have at least one tempering element and one heat sink. The tempering element can be configured in the form of one or more thermoelectric elements, for example one or more Peltier elements.

In this embodiment, at least one tempering element is arranged between the tempering block and the heat sink.

In an advantageous embodiment, all ejection plungers are mounted directly or indirectly on the heat sink via one or more further components.

The plunger drives can each comprise an electric motor. In alternative embodiments, they can be designed as hydraulic or pneumatic drives or have a piezoelectric element which is variable in its longitudinal extent. Advantageously, the plunger drives are designed as linear motors.

A device in accordance with the present disclosure for the thermal treatment of samples comprises:

a base unit comprising a receiving region for receiving one or more reaction vessels;

a tempering block module arranged in the base unit according to one of the embodiments described above; and a cover for closing the receiving region which can be moved from a first, open position into a second, closed position, wherein the cover contains a cover plate having a front surface, wherein the front surface is intended to apply a predefinable pressing force against reaction vessels placed on the tempering block when the cover is in the second position.

The reaction vessels can be sealed with a self-adhesive sealing mat or sealing foil which is attached to the reaction vessels or the microtiter plate. A sealing mat may also be placed on the reaction vessel. Alternatively, such a sealing mat can be detachably attached to the cover plate of the cover. In a further alternative embodiment, the reaction vessels can also be sealed tightly by a wax plug or closure caps. In the second position of the cover, the front surface of the cover plate is placed against the reaction vessels or against a sealing mat or sealing foil located between the cover plate and the reaction vessels, depending on the respective embodiment so that the desired pressure is exerted on the reaction vessels.

In one embodiment, the device also comprises at least one connecting element connected to the lid and a lid drive arranged in the base unit which is coupled to the at least one connecting element in order to drive a movement of the lid from the first to the second position and/or from the second to the first position, wherein the cover drive is coupled to the at least one connecting element in such a way that, during the movement from the first into the second position, the cover together with the cover plate, in a first movement segment, is initially brought from the first position into a third position in which the front surface of the cover plate extends parallel to and spaced from the tempering block, and that the cover and the cover plate, in a subsequent second movement segment, are moved in the direction of a shared normal of the front surface and a plane in which the tempering block is arranged toward the base unit until the cover has reached the second position.

Advantageously, in this embodiment the cover is not connected to the base unit via a hinge joint, as is the case with the cover of the device described in WO 02/078849 A1, and is therefore not closed or opened in a pivoting movement around such a joint. This prevents shear forces, i.e. forces with a horizontal force component, exerted by the cover plate on reaction vessels arranged in the tempering block when the cover is closed or opened. Such shear forces may be detrimental if a microtiter plate comprising the reaction vessels is closed and sealed by a sealing mat pressed between the cover and the microtiter plate. Due to the horizontal force component, the sealing mat may become undulated or displaced, in particular in the edge region, causing the reaction vessels present there to be inadequately sealed. Instead, as the cover moves from the third to the second position, the cover plate is lowered in an orientation parallel to a plane where the tempering block is located, perpendicular to the tempering block and the reaction vessels contained therein so that the front surface of the cover plate reaches all the reaction vessels simultaneously when the second position is reached and exerts a force on the reaction vessels that is directed exclusively perpendicular to the tempering block. The shifting or swelling of a seal covering the reaction vessels, e.g., a sealing mat resting on a microtiter plate, is thus avoided. When the cover is moved in the opposite direction, i.e. from the second to the third position, horizontal force components on the reaction vessels or a sealing mat resting on the reaction vessels are also prevented when the cover is opened. In addition to the controlled lifting of the reaction vessels by means of the ejection plungers, this helps to avoid sudden movements of the reaction vessels and the resulting loss of sample liquid. The cover drive, which drives the movement of the cover and the cover plate perpendicular to the plane of the tempering block, can also be used for variable, and thus predefinable, setting of a pressure force of the cover plate on the reaction vessels.

The aforementioned plane in which the tempering block is arranged shall be understood here and in the following to mean an imaginary plane defined by a surface of the tempering block. This surface can be a smooth surface or comprise receptacles for reaction vessels. This plane is generally horizontally oriented, that is, in particular during the intended use of the device. The receptacles can, for example, be designed as recesses in the surface or as for example cylindrical receptacles placed on the surface.

The coupling of the cover drive to the cover implemented via at least one connecting element can advantageously be implemented via two connecting elements, for example, connecting plates or connecting arms, which are attached to sides of the cover located opposite each other. In all possible embodiments described below, at least one connecting element can be designed in the form of two connecting elements arranged on opposite sides of the cover.

The cover drive can be controllable for setting the pressing force acting perpendicularly to the front surface of the cover plate, which the cover drive exerts on the cover and the cover plate via the at least one connecting element during the second movement segment, so that the pressing force (or a contact pressure) of the front surface of the cover plate against reaction vessels placed on the tempering block can be set and/or controlled by means of the cover drive.

The device can comprise a drive controller which is connected or can be connected to all plunger drives of the tempering block module and is set up to control the plunger drives independently of one another, for example by means of a specification by a user or a higher-level controller connected to the drive controller. The drive control may be arranged wholly or partially within the base unit.

The cover drive can have a motor, especially an electric motor. For example, on the basis of a user specification or a higher-level control connected to the drive control, the drive control can be configured to adjust the force which the cover drive exerts on the cover and the cover plate via at least one connecting element. For this purpose, the drive control unit can comprise a processor and a memory, wherein an operating program for accordingly controlling and setting the force to be exerted is stored in the memory, and wherein the processor is configured to execute the program. A user or the higher-level control unit can thus arbitrarily set the force to be exerted by a corresponding signal to the drive control unit, which can be generated, for example, by an input of the user or in an automated manner by the control unit.

The drive control and/or the higher-level control can also be configured to generate a control signal representing the force to be set based on a predefined identifier of one or more reaction vessels contained in the base unit and to send it to the cover drive and/or the motors of the tempering block module. The aforementioned operating program can provide a corresponding functionality. Since it may be advantageous to set different pressing forces of the cover plate against the reaction vessels for the treatment of samples contained in different types of reaction vessels, the device in this embodiment allows an identifier of the reaction vessels to be entered or read in. From the identifier, a control signal can be generated for the cover drive or the motor of the cover drive by the drive control unit and/or the higher-level control unit, so as to set a pressing force that matches the corresponding identifier.

The drive control may be configured, in a first operating mode, to drive the plunger drives in such a way that the ejection plungers are moved to the second position and/or are moved back into the first position at different times. This permits virtually any movements, for example a wave-like movement, of a microtiter plate lifted off the tempering block by the ejection plungers by means of the ejection plungers. In this way, the liquid-filled reaction vessels can be lifted out of the tempering block gently and smoothly as possible.

The drive control may also be configured to drive the plunger drives in a second operating mode in such a way that the ejection plungers are moved synchronously to the first and/or second position.

The drive control can also be configured to control the cover drive and the plunger drives so that when the cover is moved from the second position to the first position, the ejection plungers are moved synchronously or successively from their first position to their second position. Advantageously, the movement of the cover and the ejection plunger can be coordinated with one another so that the cover plate applies a pressure force to and thus mechanically stabilizes the reaction vessel until the ejection plungers have reached their second position. Thereafter, the cover continues to move parallel to the plane in which the tempering block is arranged until the third position of the cover is reached. In this way, the reaction vessels remain securely stabilized until they are brought into a position in which they can be securely gripped by an automatic gripper arm.

In order to implement the various operating modes, the drive control may comprise one or more operating programs which the drive control can execute and which are used to generate and send control commands to the plunger drives or optionally to the cover drive which causes the ejection plungers to move according to the individual operating modes.

The at least one connecting element connecting the cover to the cover drive can be coupled to a guide arranged in the base unit in such a way that the movement of at least one connecting element during the second movement segment is guided linearly in the direction perpendicular to the cover plate. The cover drive can thus exert on the connecting element an arbitrarily predefinable force directed perpendicularly to the front surface of the cover plate, which also determines the pressing force with which the front surface of the cover plate is pressed against reaction vessels arranged in the tempering block.

A section of the guide which guides the movement of the at least one connecting element during the second movement segment extending between the third and the second positions can extend perpendicularly to the tempering block, that is, perpendicularly to the plane in which the tempering block is arranged.

The cover drive can comprise a rotatable drive shaft which is rigidly connected to at least one lever arm extending perpendicularly to the drive shaft, wherein the lever arm is coupled to at least one connecting element via a linear guide rotatably mounted on the connecting element. In this way, it is possible to vary an angle enclosed between the lever arm and the connecting element, or an angle enclosed between the lever arm and an imaginary plane extending through the front surface of the cover plate, when the cover, together with the cover plate, is moved from the first into the second position or in the opposite direction.

A movement of the at least one connecting element during the first and second movement segments can be guided in a guide arranged in the base unit. For example, the at least one connecting element can have at least one coupling element, for example a pin, wherein the guide comprises a guide plate that is arranged in the base unit and has a guide slot in which the at least one coupling element is guided.

In an advantageous embodiment, the cover drive comprises a self-locking gear system. The gear system can be a worm gear mechanism, for example. This can have a high gear ratio, so that it is self-locking or essentially self-locking. Other forms of self-locking gear systems are also conceivable, wherein self-locking can be produced, for example, by suitable material pairings. By means of the self-locking, it is possible to design the device in such a way that, after the second position of the cover is reached, that is, the closed end position of the cover in which the cover plate bears against the reaction vessels with the predefined pressing force, the motor of the cover drive is switched off, without the pressing force acting on the reaction vessels diminishing. If the gear system is not self-locking or not completely self-locking, the pressing force can be maintained by continuously operating the motor, optionally with a lower power consumption compared to the power consumption when moving the cover between the first and second positions. Alternatively, the base unit can also comprise a hand brake which maintains the cover position in the closed state when the gear system is not self-locking or not fully self-locking.

The present disclosure also comprises a method for removing a microtiter plate placed on a tempering block, having a plurality of reaction vessels, from a device for the thermal treatment of samples, wherein the tempering block is part of a tempering block module, and wherein the tempering block module is arranged in a base unit of the device, comprising:

moving a cover closing the base unit, with a cover plate, along an initial moving section from a closed position, in which a front surface of the cover plate exerts a pressing force against the microtiter plate, to an intermediate position, in which the front surface of the cover plate runs parallel to and is at a distance therefrom;

afterwards, moving the cover to an open position; and moving at least the first and one second ejection plunger which are movably mounted in the tempering block module perpendicular to a plane in which the tempering block is arranged, from a first position retracted into the tempering block module to the second position extended from the tempering block module by means of a first plunger drive moving the first ejection plunger and by means of a second plunger drive moving the second ejection plunger, wherein the first and the second ejection plunger strike against an edge of the microtiter plate during the movement and lift the microtiter plate from the tempering block.

The thus lifted microtiter plate can be removed from the tempering block by means of an automated gripper arm. After they have reached the second position, it is possible to retract the ejection plungers partially in the direction of the first position in order to bring the microtiter plate into a position which is optimal for the operation of the gripping arm.

The movement of the cover and the movement of at least the first and second ejection plungers, preferably all the ejection plungers, may be simultaneous and synchronous so that the cover plate rests against the microtiter plate until the ejection plungers have reached the second position.

The cover can be moved by means of a cover drive of the device controlled by a drive control. The plunger drives can also be controlled by the drive control.

Advantageously, several ejection plungers, for example, three, four or six, are used to lift the microtiter plate out of the tempering block.

The method can advantageously be carried out by means of a device according to one of the embodiments described above.

In an advantageous version of the process, the tempering block module comprises a number of ejection plungers, e.g., at least four, and a number of motors equal to the number of ejection plungers, wherein each plunger drive is operatively connected to one of the ejection plungers to move the ejection plungers from their first position to the second position and/or from their second position to the first position.

BRIEF DESCRIPTION OF THE DRAWINGS

The present disclosure is explained in further detail below on the basis of the exemplary embodiment shown in the figures. Shown are.

DETAILED DESCRIPTION

Figure 1A:
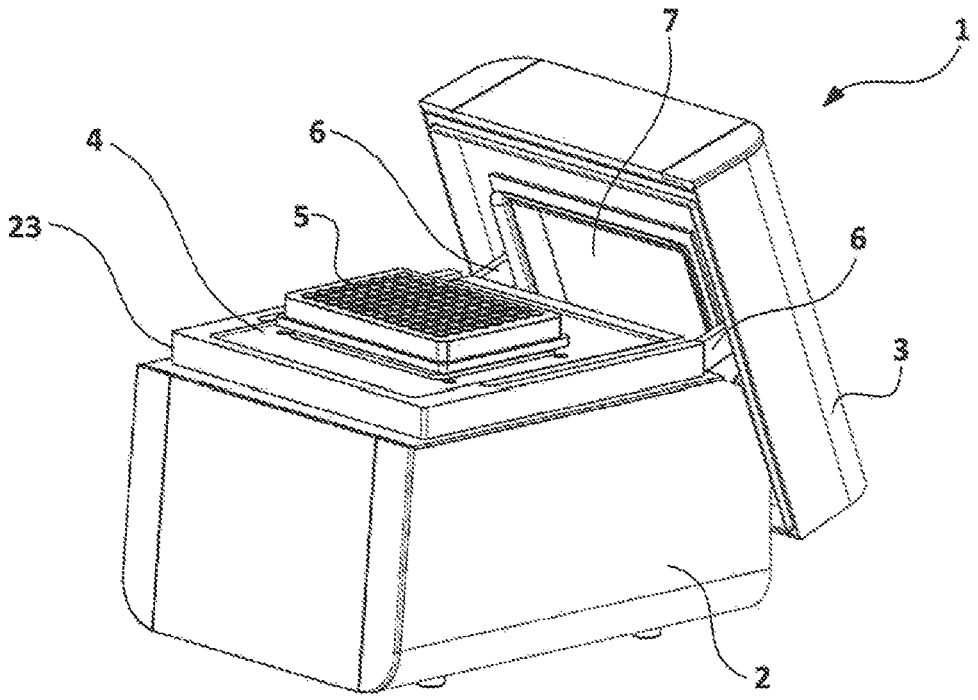
FIGS. 1*a*-1*d* show perspective views of a device for thermal treatment of samples when the cover is in different positions.

The figures schematically show an exemplary embodiment for a device 1 with a tempering block module 23 for the thermal treatment of samples, a so-called thermocycler. Identical reference numerals denote identically configured elements of the device. A plurality of identically acting modifications are possible without departing from the inventive idea.

Figure 1B:
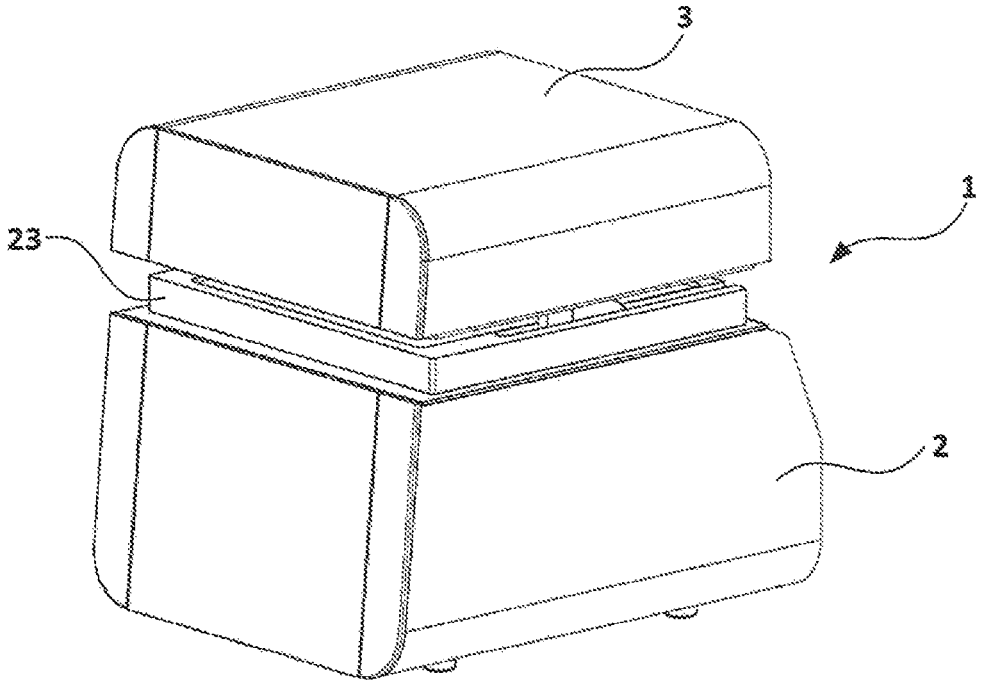
Figure 1C:
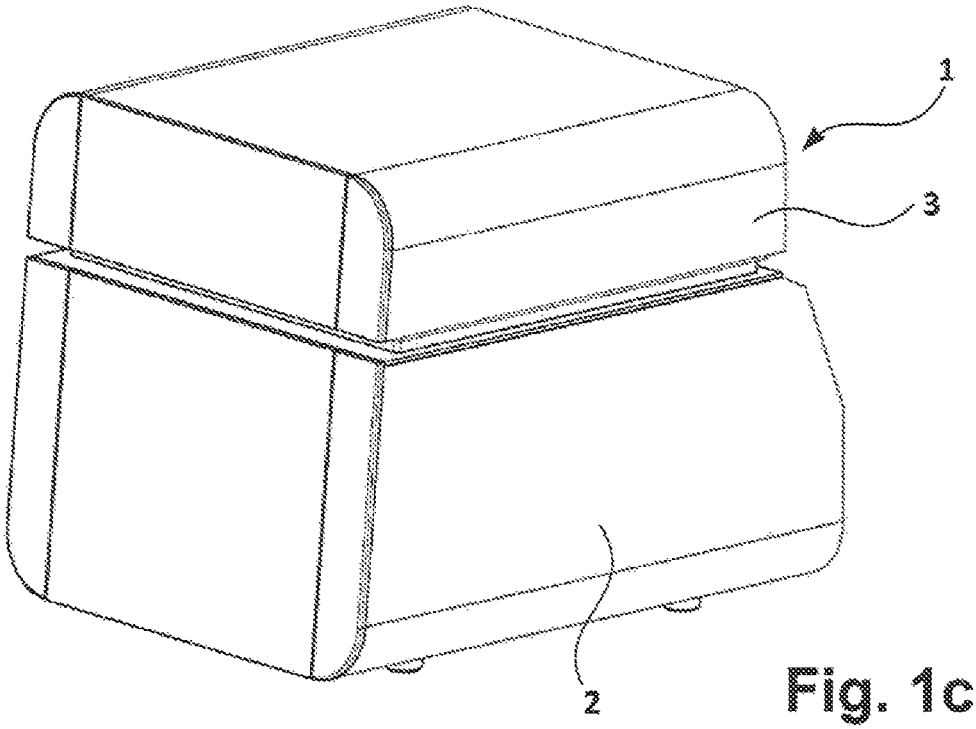
Figure 1D:
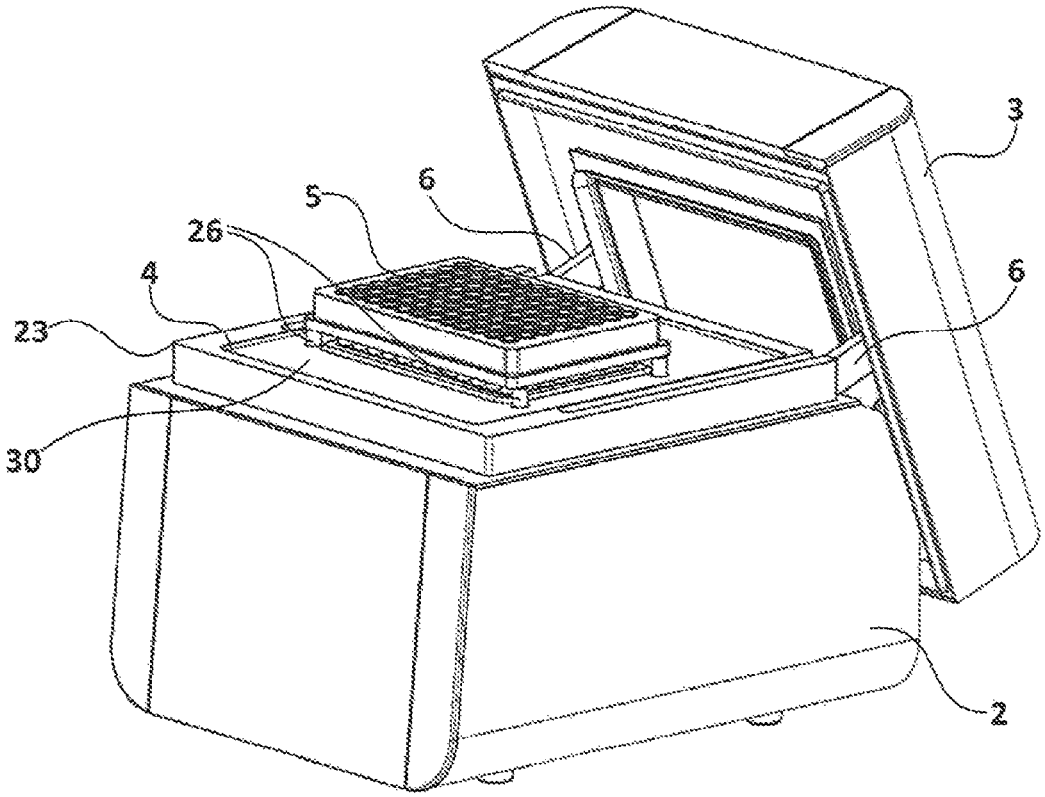

FIGS. 1*a*-1*d* show perspective views of the device 1. It possesses a base unit 2 and a cover 3 which is shown in various positions in FIGS. 1*a*-1*c*. A tempering block module 23 with a tempering block 13 is arranged in the base unit (FIG. 1*d*). The tempering block module 23 has on its upper side a cover frame 30 which leaves the tempering block 13 exposed. The area arranged above the tempering block 13 forms a receiving area 4 in which reaction vessels with liquid samples to be thermally treated can be arranged. The tempering block 13 is made of a metal having high thermal conductivity, for example silver or aluminum, and has a plurality of receptacles for reaction vessels.

FIGS. 1*a*, 1*c* and 1*d* show a rectangular microtiter plate 5 arranged in the receiving area 4, which has a plurality of depressions serving as reaction vessels. Typically, such microtiter plates are made of plastic. In the present example, the microtiter plate 5 is placed on the tempering block 13 so that the depressions formed in the microtiter plate 5 serving as reaction vessels project into the receptacles.

In the example shown here, the receptacles are designed as cylinders, which are situated upright on a base surface of the tempering block 13. Alternatively, the tempering block 13 can also be designed substantially cuboid with depressions formed in one of its surfaces as receptacles for reaction vessels or with a flat surface. The receptacles, or the upper edges or openings thereof, are essentially located in a horizontal plane, which is also referred to here as the plane in which the tempering block 13 is oriented. The microtiter plate 5 is oriented parallel to this plane during operation of the device. When the front surface of the heatable cover plate 7 bears against the microtiter plate 5, it is likewise oriented parallel to this plane.

The cover 3 is connected to the base unit 2 via two connecting elements 6, which in the present exemplary embodiment are designed as connecting arms. The connecting arms 6 are coupled to a cover drive, which is arranged in the base unit 2 and will be described in more detail below, and which can move the cover 3 for automatically opening and closing the base unit 2. Arranged in the cover 6 is a heatable cover plate 7, the front surface of which points towards the receiving area 4 and is intended to rest against the reaction vessels formed in the microtiter plate 5 when the cover 3 is closed.

In FIG. 1*a*, the cover 3 is in an open first position in which the cover plate 7 is inclined with respect to the surface of the microtiter plate 5. In this position of the cover 3, unimpeded access to the receiving area 4 is possible, for example for insertion or removal of the microtiter plate 5. This insertion and removal of the microtiter plate 5 can take place, for example, by means of a robot gripper arm. The device 1 can be operated completely automatically in combination with a robot operating system. In FIG. 1*c*, the cover 3 is in a closed second position. In this position of the cover 3, the front surface of the cover plate 7 bears against the surface of the microtiter plate 5 with a specifiable pressure so that the microtiter plate 5 is pressed against the tempering block 13 for uniform heat transfer. At the same time, the cover plate 7 closes the reaction vessels formed in the microtiter plate 5.

FIG. 1*b* shows a third position of the cover 3, which forms an intermediate position during the movement of the cover 3 from the first into the second position or also during the movement of the cover 3 from the second into the first position. In this third position, the cover 3 is oriented parallel to the microtiter plate 5 or to the tempering block arranged beneath the microtiter plate 5, and is spaced from the surface of the microtiter plate 5.

The device 1 is designed in such a way that a movement of the cover 3 from the first, open position into the second, closed position extends over the third position, that is, the cover 3 is initially brought from the first into the third position in an arc-shaped movement in a first movement segment. From this third position, the cover 3 is moved vertically in a second movement segment, i.e. perpendicular to the plane in which the tempering block is oriented, and thus also perpendicular to the surface of the microtiter plate 5, towards the latter and is thus brought into the second, closed position.

A movement of the cover 3 in the opposite direction, that is, from the second, closed position into the first, open position, likewise takes place via the third position, in that, in a first segment of this movement, the cover 3 is moved away from the microtiter plate 5 perpendicularly to the surface thereof, until it reaches the third position. In a subsequent second movement segment, the cover 3 is moved from the third position to the first position in an arc-shaped movement.

The device 1 has an ejection mechanism which serves to lift the microtiter plate 5 out of the tempering block 13 after completion of the thermal treatment, in order to make it easier for a robot gripper arm to remove the microtiter plate 5 from the receiving area 4. FIG. 1*d* shows 30 ejection plungers 26 protruding from the cover frame. In the exemplary embodiment shown here, an ejection plunger 26 is arranged on each side edge of the cuboid tempering block 13. The ejection plungers 26 can be moved back and forth between a position retracted into the tempering block module 23 (FIG. 1*a*) and a position extended from the tempering block module 23 perpendicular to a surface in which the tempering block 13 is arranged or perpendicular to the surface of the microtiter plate 5. When moving from the retracted to the extended position, the ejection plungers 26 strike the edge of the microtiter plate 5 with their upwardly directed front face against an underside and lift it out of the tempering block 13 with their further movement until the extended position is reached.

Figure 2:
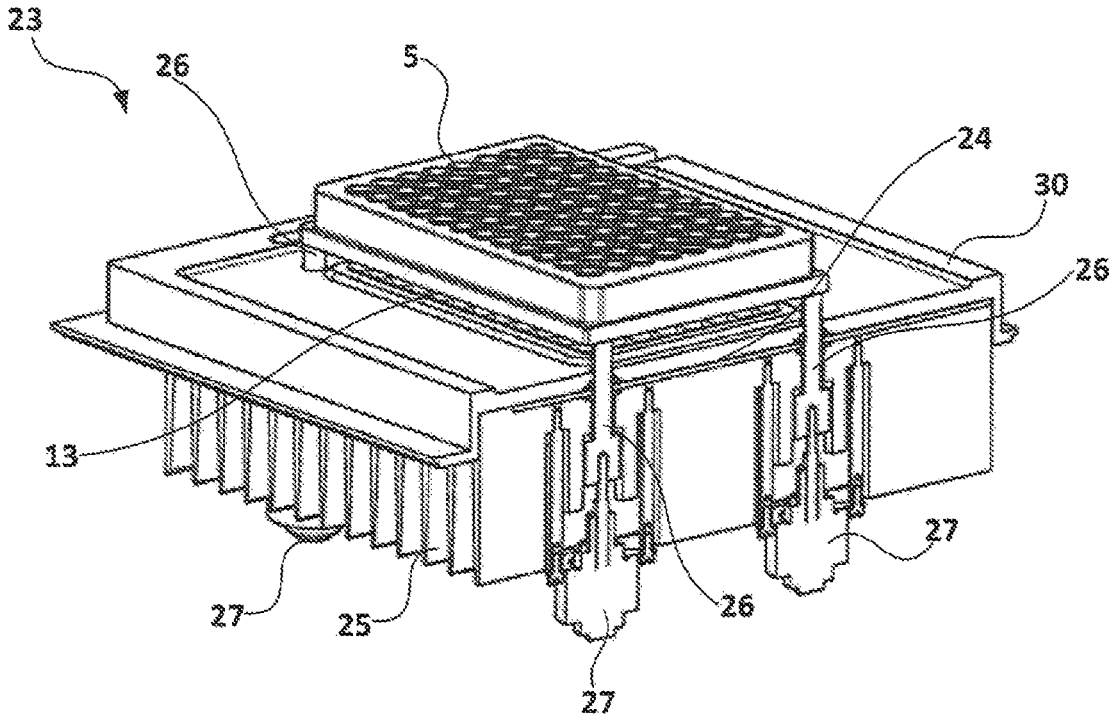
FIG. 2 shows a perspective detail view of a tempering block module of the device shown in FIGS. 1*a*-1*d;*

FIG. 2 shows a schematic perspective longitudinal section view of the tempering block module 23. The tempering block module 23 is arranged in the upper region of the base unit 2. In addition to the tempering block 13, it has a tempering device with one or more tempering elements 24 and a heat sink 25 arranged on the side of the tempering elements 24 facing away from the tempering block 13. The heat sink 25 is covered by the cover frame 30. The tempering elements 24 may comprise thermoelectric elements, for example Peltier elements.

A control unit may be provided in base unit 2 to control or regulate the thermoelectric elements 24 to pass through predefined temperature cycles in order to carry out polymerase chain reactions. The temperature control system can also be implemented at least partially in an external control unit connected to the thermoelectric elements 24 via the interface 2. The temperature control system is designed in the conventional way and is therefore not described in detail here.

In the exemplary embodiment shown here, four ejection plungers 26 are arranged in the tempering block module 23, each at the corners or side edges of the tempering block 13. Each ejection plunger 26 is assigned its own plunger drive 27. The plunger drives 27 are mounted on the heat sink 25 either directly or indirectly via one or more other components. They are operatively connected to the ejection plungers 26 for driving their movement from their retracted position in the tempering block module 23 to a position extended from the tempering block module 23 and in the opposite direction.

Figure 3A:
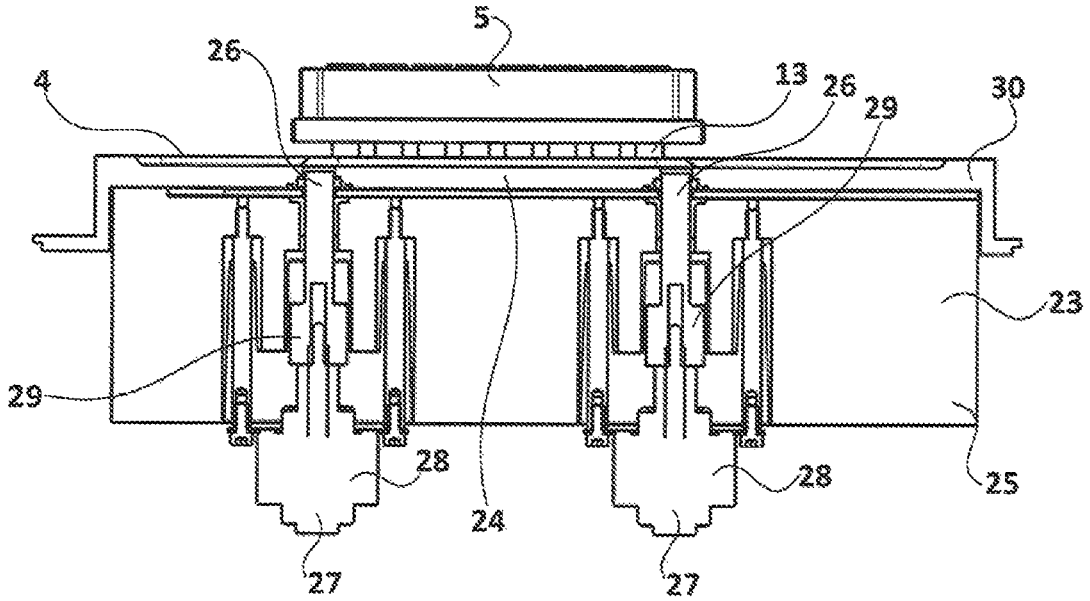
FIGS. 3*a* and 3*b* show detailed side views of the tempering block module shown in FIG. 2 with ejection plungers in a first, retracted position (3*a*) and in a second, extended position (3*b*)
Figure 3B:
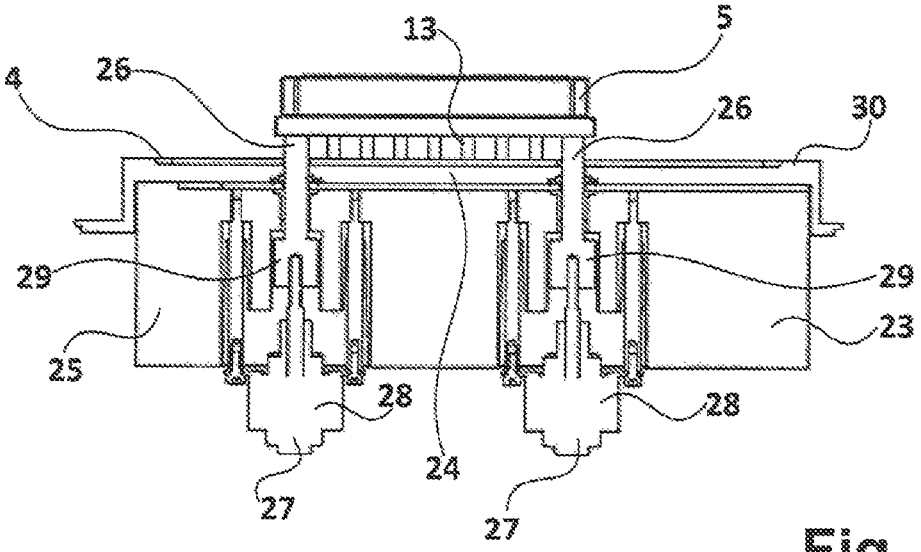

FIGS. 3*a* and 3*b* show the tempering block module 23 with the tempering block 13, the microtiter plate 5 placed thereon, and two of the four ejection plungers 26 in a longitudinal sectional view.

The ejection plungers 26 are shown in FIG. 3*a* in their first position retracted from the tempering block module 23 and in FIG. 3*b* in their second position extended out of the tempering block module 23. The ejection plungers 26 are arranged at the periphery of the tempering block 13 so that the ejection plungers 26 strike the underside of the microtiter plate 5 when they move from the retracted position to the extended position and take the microtiter plate 5 along with them when they move further upwards. When the extended position of the ejection plungers is reached, the entrained microtiter plate 5 is lifted off the tempering block 13 in such a way that an automatically operated robot gripper arm can easily grip it. In the present exemplary embodiment, the ejection plungers 26 are arranged at the corners of the rectangular base area of the tempering block 13. It is possible to provide additional ejection plungers along the sides of the base area or to provide ejection plungers only on the sides. Of course, base areas for the tempering block 13 other than rectangular ones are also conceivable. The ejection plungers are then correspondingly arranged at suitable positions along the periphery of the tempering block.

The plunger drives 27 can be designed as electric drives, but also as pneumatic or hydraulic drives. In this example, the plunger drives 27 each comprise an electric motor 28, which is coupled to the ejection plunger 26 via a spindle 29 converting a rotational movement into a linear movement. The plunger drives 27 can be controlled individually by means of a drive control. Such a drive control configured for individual actuation of the plunger drives 27 can be arranged, for example, at least partially in the base unit 2.

Thus, it is possible to implement different movement patterns of the ejection plungers 26 by means of the drive control. For example, the ejection plungers 26 can be moved synchronously so as to keep the microtiter plate 5 permanently in an exactly horizontal orientation during the ejection movement. It is also possible to move only individual ejection plungers 26.

During the thermal treatment of the sample, the plastic material of the microtiter plate 5 at the tempering block 13 may start to partially flow and adhere to the receptacles of the tempering block 13. So as to detach the liquid-filled reaction vessels from the receptacles without excessive vibrations, the drive control unit can advantageously be configured to activate the plunger drives 27 in such a way that these alternately reach the extended position, so that the microtiter plate 5 is lifted off the tempering block 13 in a pulsating or wave-like movement.

In FIGS. 4*a*-4*e*, the device 1 is shown schematically in a sectional view along a first vertical sectional plane with different positions of the cover 3. In this view, the tempering block 13 can also be seen in FIGS. 4*a*, 4*b*, 4*c* and 4*e*.

A cover drive 8 for moving the cover 3 is arranged in the base unit 2. The cover drive 8 is coupled to the connecting elements 6 via a respective coupling device, which will be described in more detail below. In the sectional view shown in FIGS. 4*a*-4*e*, only one of the coupling devices can be seen which couples the cover drive 8 to one of the connecting elements 6. A coupling device, which is designed in an analogous manner (symmetrically to the coupling device shown here) and which couples the cover drive 8 to the second connecting element 6 arranged on the opposite side of the cover, is arranged on the opposite side of the base unit. The visible coupling device will be described hereafter.

The cover drive 8 comprises a motor (not visible in FIGS. 4*a*-4*e*) and a drive shaft (not visible in FIGS. 4*a*-4*e*) rotatable about an (imaginary) rotational axis R. The drive shaft is rigidly connected to the lever arm 9 extending perpendicularly to the rotational axis R. A linear guide 10 in which the lever arm 9 is guided is arranged on the connecting element 6. The linear guide 10 is attached to the connecting element 6 so as to rotate about an (imaginary) second rotational axis extending parallel to the rotational axis R.

A guide plate 11, which is oriented perpendicularly to the rotational axis R of the drive shaft, is arranged in the base unit 2. A guide slot 12, which has a first, arc-shaped section and a second, linear section oriented perpendicularly to the microtiter plate 5, is formed in the guide plate 11. The movement of the connecting element 6 caused by the cover drive 8 is guided in the guide slot 12 in the guide plate 11. To this end, the connecting element 6 has two pins 31 which are guided in the guide slot 12. As mentioned, a mirror-image coupling device is located on the opposite side of the cover drive 8 in the base unit 2 to drive and guide the movement of the other connecting element 6. Instead of the guides described here, other mechanisms can be used which convert a rotational movement of the drive shaft into a linear movement of the connecting elements 6.

Figure 4A:
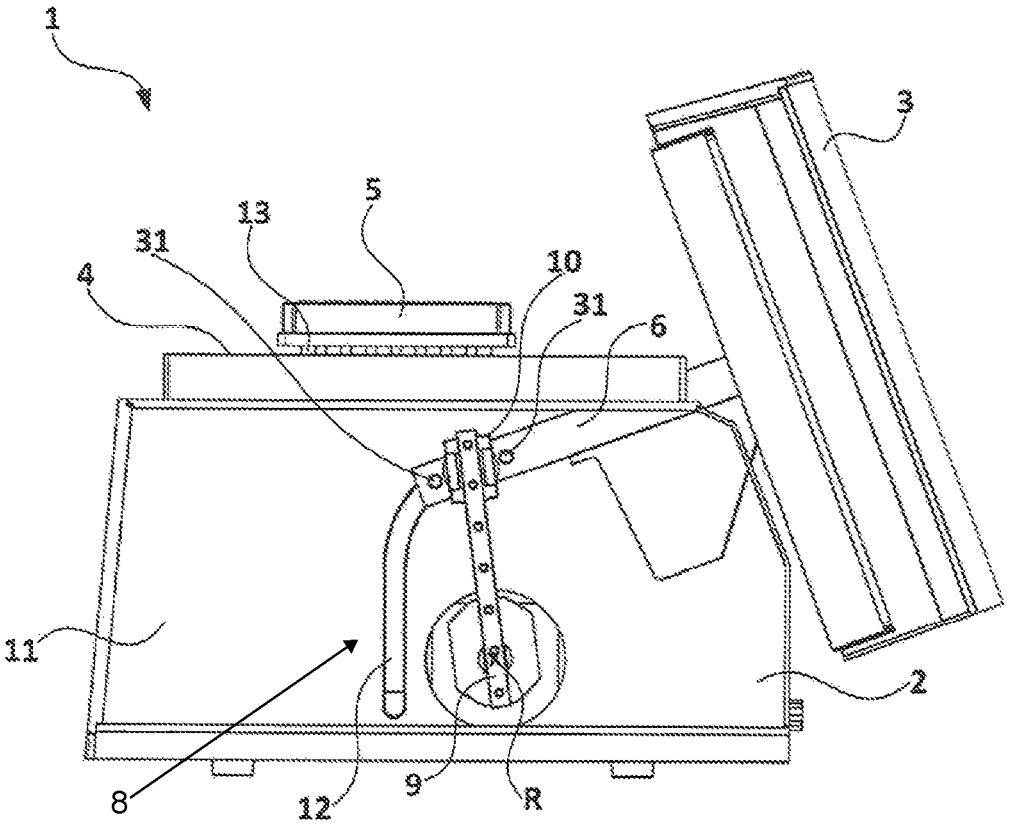
FIGS. 4*a*-4*e* show side sectional views of the device according to FIGS. 1*a*-1*d* in different positions of the cover with a first sectional plane.
Figure 4B:
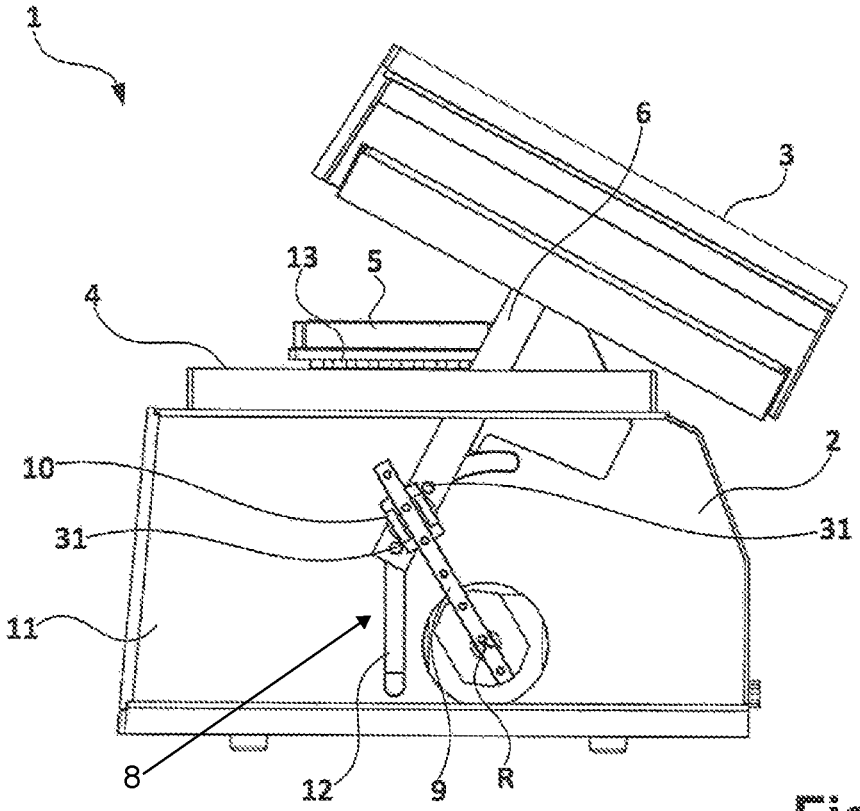
Figure 4C:
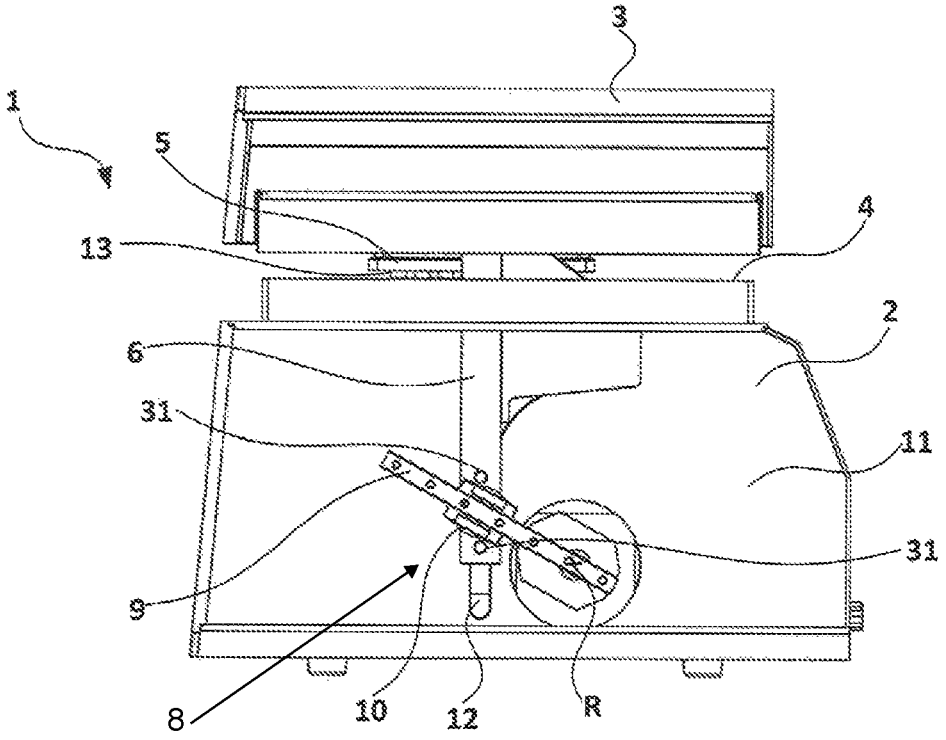
Figure 4D:
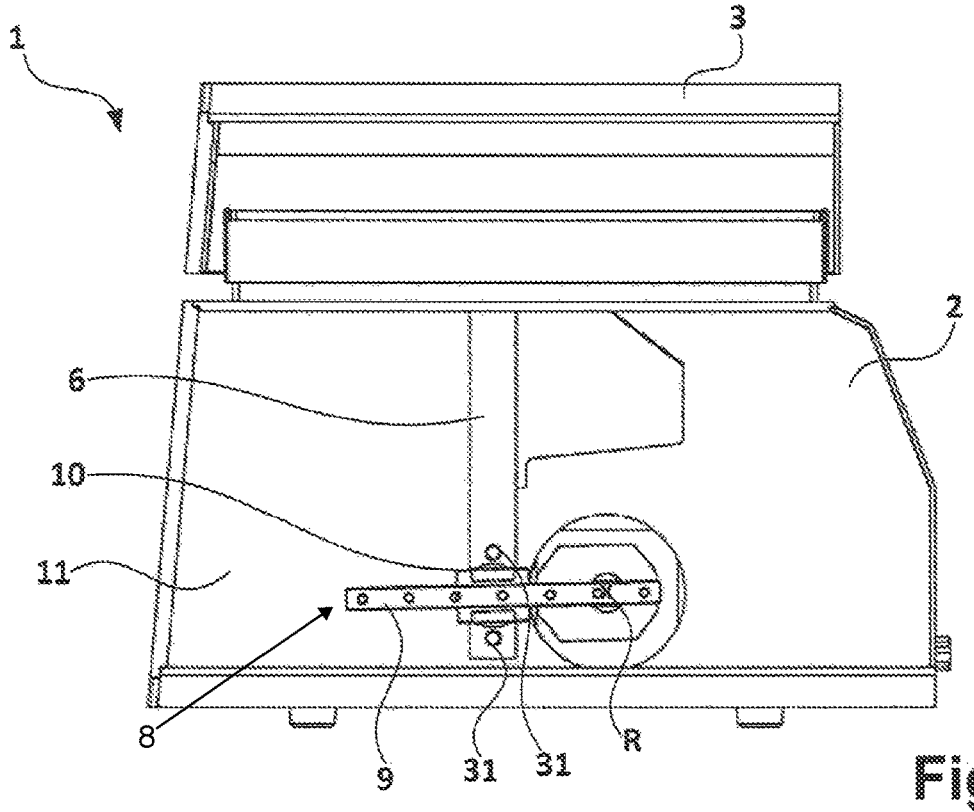
Figure 4E:
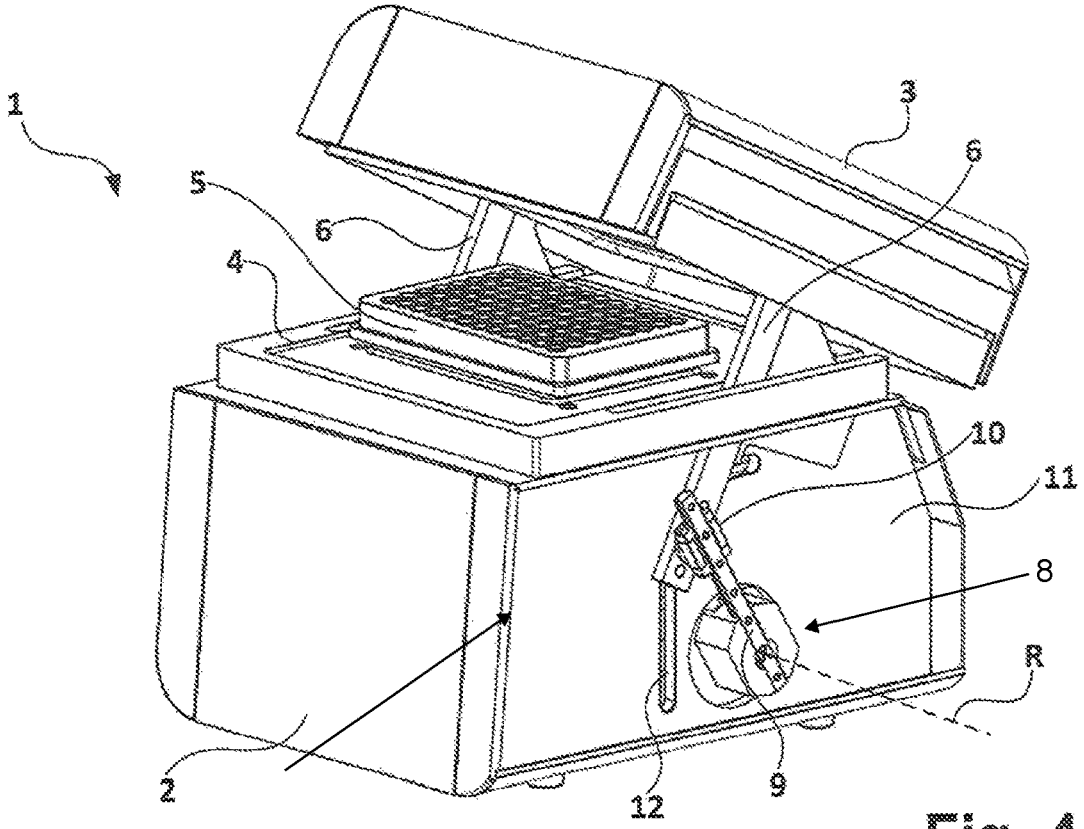

In FIG. 4*a*, the cover 3 is in the first, open position. The pins 31 of the connecting element 6 are located at a first end of the guide slot 12. A rotation of the drive shaft about the rotational axis R causes a movement of the pins 31 along the arc-shaped section of the guide slot 12 via the guidance of the lever arm 9 in the linear guide 10. This movement results in an arcuate movement of the lid 3 over the position shown in FIG. 4*b*. This movement causes the angle of the cover 3 or of the cover plate 7 arranged therein to become increasingly smaller with respect to the plane in which the tempering block 13 is arranged, until the cover 3 and the cover plate 7 are oriented parallel to this plane or to the microtiter plate 5, but are still at a distance from the microtiter plate 5. This ends the first movement segment, and the third position of the cover 3 is reached, FIG. 4*c*. The further movement of the drive shaft causes a linear downward movement of the connecting element 6 in the guide slot 12 via the linear guide 10, so that the cover 3 and the cover plate 7 arranged therein move in a perpendicular direction towards the microtiter plate 5, in a manner oriented parallel to the microtiter plate 5, until the front surface of the cover plate 7 strikes against the microtiter plate 5. Ideally, no horizontal force components (shearing forces) are exerted on the microtiter plate 5. There is thus no risk that one side of the microtiter plate 5 will be lifted off or displaced on the tempering block 13.

A pressing force of the front surface of the cover plate 7 against the microtiter plate 5 is caused by a further rotational movement of the drive shaft. This can be predefined by the torque of the drive shaft or by the force which is accordingly exerted on the connecting elements 6 by the cover drive 8 via the coupling device. When the cover plate 7 rests against the microtiter plate 5 with the predefined contact pressure, the second position of the cover 3 (FIG. 4*d*) is reached.

The rotational movement of the drive shaft in the opposite direction causes a corresponding movement of the cover 3 and the cover plate 7 running in the opposite direction from the second position via the third position into the first position, guided in the guide slot 12.

Alternative embodiments of the coupling unit between the cover drive 8 and the connecting elements 6 or the cover 3 are conceivable. For example, instead of the linear guide 10 for the lever arm 9, a combination of a guide slot and an elongated hole can also be used for coupling the lever arm 9 to the connecting element.

Figure 5A:
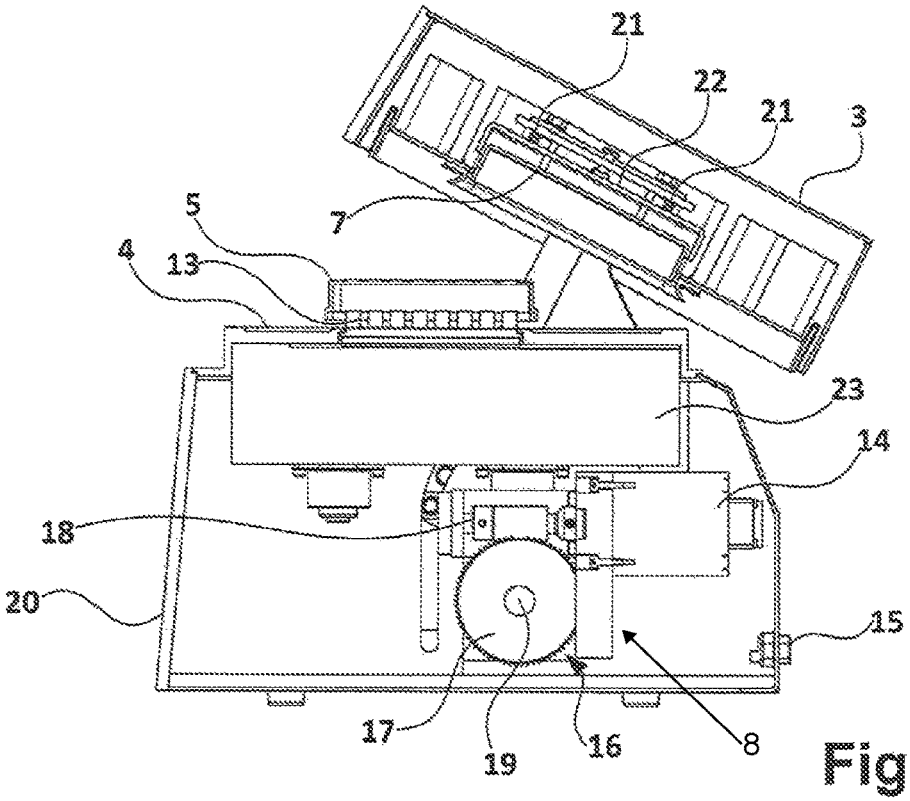
FIGS. 5*a* and 5*b* show side sectional views of the device in accordance with FIGS. 1*a*-1*d* with a second sectional plane.

FIGS. 5*a* and *b* show further schematic sectional views of the device 1, wherein the second sectional plane considered here extends parallel to the first sectional plane used in FIGS. 4*a*-4*e*. The cover drive 8 can be seen in more detail in these sectional views. The cover drive 8 comprises a controllable motor 14, for example an electric motor, which can be connected to a drive control unit provided in the base unit itself or outside the base unit. An interface 15 is provided in the base unit for optional connection to an external drive control. In the present example, the cover drive 8 further comprises a, preferably self-locking, gear system 16 which can be actuated by the motor 14. In the present exemplary embodiment, the gear system 16 is designed as a worm gear mechanism, but other embodiments which are able to cause the rotational movement of a drive shaft are also possible. The gear system 16 in the present example comprises a gear wheel 17 (worm gear) and a helical worm shaft 18, the rotational movement of which causes the gear 17 to rotate. The gear wheel 17 is rigidly connected to the drive shaft 19 already mentioned above in connection with FIGS. 4*a*-4*e* (visible in FIGS. 5*a* and 5*b*), which drives the movement of the cover 3 via the lever arm 9, the linear guide 10 and the connecting element 6 guided in the guide slot 12.

The front housing wall 20 of the housing of the base unit 2 is designed removable. In this way, the interior of the housing, especially the worm shaft 18, is accessible from outside for maintenance or repair. In the event that the cover 3 cannot be opened automatically by means of the drive control, for example in the case of a defect, it is possible to actuate the worm shaft 18 manually, for example by means of a screwdriver, and to thus open the cover 3 manually to reach the microtiter plate 5 and the samples contained therein.

Figure 5B:
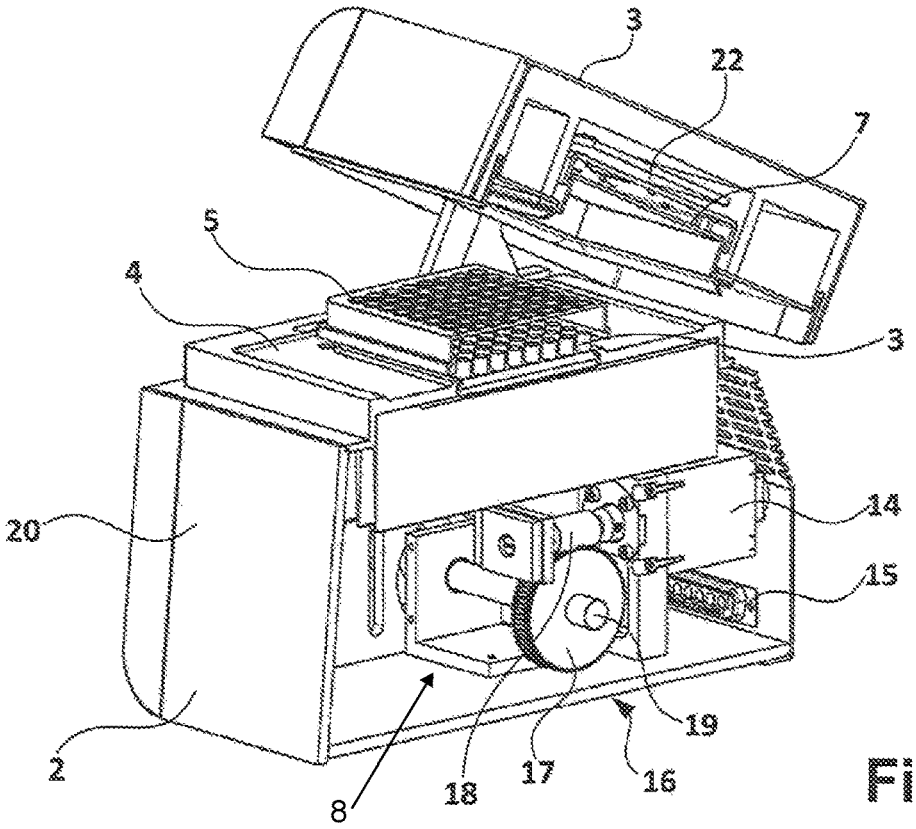

The sectional views of FIGS. 5*a* and 5*b* also show the design of the cover 3 in detail. As described, the cover 3 contains the cover plate 7, which can be heated by means of a heating module. This is coupled via pressure springs 21 to a pressing panel 22 which in turn is rigidly connected to the connecting elements 6. The force exerted by the cover drive 8 on the connecting elements 6 is transmitted to the cover plate 7 via the pressure springs 21. The heating module is designed in a conventional manner and can be connected to a power supply via the interface 15 of the base unit 2.

Figure 6:
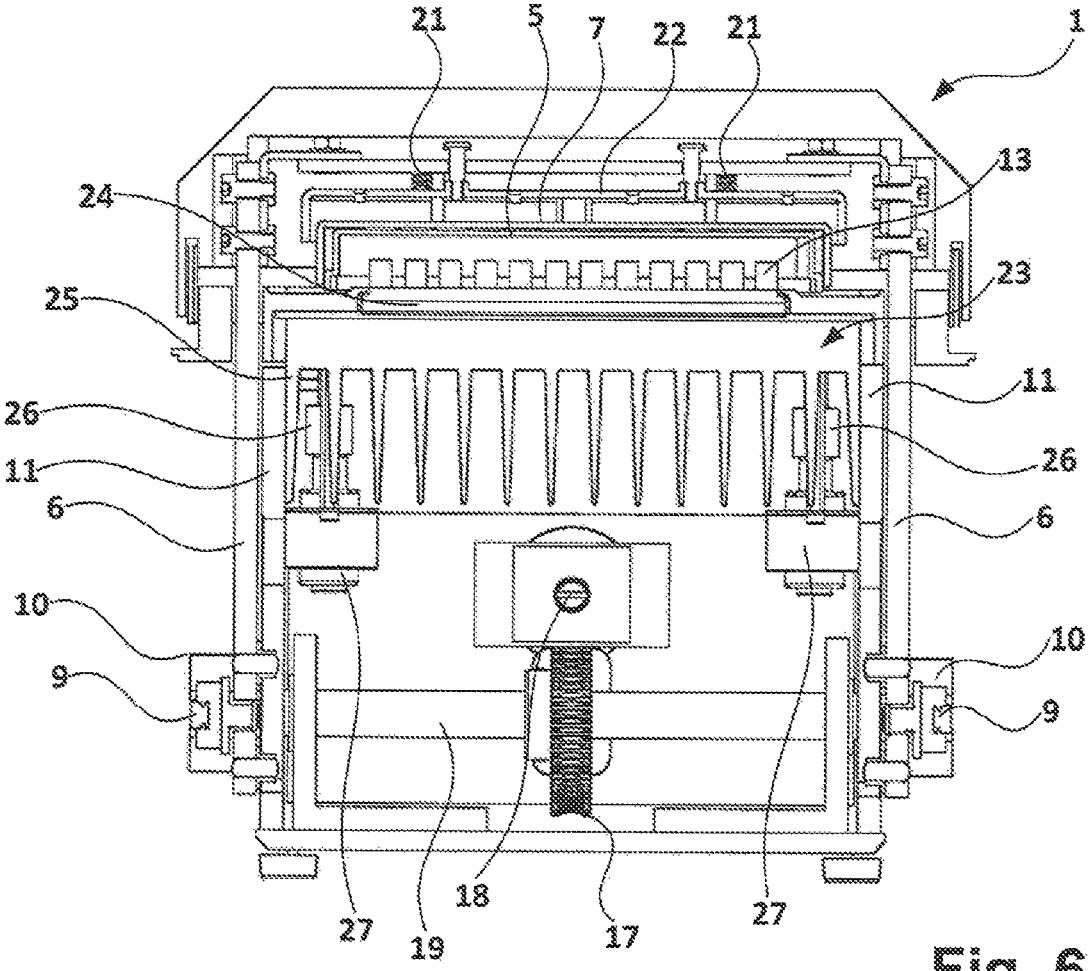
FIG. 6 shows a front sectional view of the device in accordance with FIGS. 1*a*-1*d* with a third sectional plane extending perpendicularly to the first and second sectional planes.

FIG. 6 shows a schematic longitudinal sectional view of the device 1 when the cover 3 is closed (in the second position) along a third sectional plane which extends perpendicularly to the first (FIGS. 4*a*-4*e*), and second (FIGS. 5*a* and 5*b*) sectional planes. In this view, it is apparent that the coupling device between the gear system 16 and the connecting elements 6 has a mirror-image design with respect to an (imaginary) plane of symmetry extending through the gear wheel 17 of the gear system 16. Each of the connecting elements 6 is therefore coupled to the drive shaft 19 via a lever arm 9 guided in a linear guide 10, wherein the movement of the connecting elements 6 is guided in each case by a pin, which can be moved in a guide slot of a guide plate 11 and connected to one of the connecting elements 6 (not visible in FIG. 6).

In the very advantageous exemplary embodiment described here, the drive control unit is designed both to control the cover drive 8 for the movement of the cover 3 and to control the plunger drives 27 for the movement of the ejection plungers 26. In this case, the drive control unit can be designed to match the movement of the cover and the movement of the ejection plungers 26 according to a predefined operating program. Thus, when the cover 3 is lifted from the first position into the third position, the drive control unit at the same time can move the ejection plungers 26 of the mechanism described in more detail in FIGS. 2, 3*a* and 3*b* into the extended position so that the microtiter plate 5 remains pressed against the front surface of the cover plate 7 while it is being lifted off the tempering block 13. Thus, the reaction vessels remain additionally held during the lifting of the microtiter plate 5 by the cover plate 7 and are hence protected against sudden movements when detached from the tempering block.

As mentioned above, an external drive control connected to the motor 14 via interface 15 can be provided to control the cover drive 8 and the previously described plunger drives 27 of the ejection mechanism for the microtiter plate 5. However, it is also possible for the drive control to be arranged at least partially in the base unit 2, for example in the form of a circuit implemented on a circuit board arranged in the base unit 2. The drive control unit comprises at least one processor, memory elements, and one or more operating programs stored in one or more of the memory elements and executable by the processor. The operating program is, or the operating programs are, used to operate and control the device 1, for example for controlling the cover drive 8. The drive control unit can be configured, by means of an operating program, to read in an identifier of a reaction vessel, for example a microtiter plate 5, to be inserted into the receiving region 4, to determine, based on the identifier, a pressing force suitable for the specific reaction vessel with which the cover plate 7 is to bear against the reaction vessel when the cover 3 is in the second position, and to control the cover drive 8 for applying the determined pressing force.

The drive control be set up by means of the operating program in order to move the movement of the ejection plunger 26 according to an operating mode selected from a plurality of possible operating modes, especially in coordination with a concurrent cover movement. Thus, as already mentioned, the drive control can actuate the ejection plunger 26 simultaneously and synchronously in a first operating mode by means of the plunger drives 27 so that all ejection plungers reach their extended position simultaneously, or are simultaneously moved into the retracted position. In a second mode of operation, the drive control may actuate the ejection plunger 26 to move it sequentially and/or alternately to its extended and retracted positions to realize a pulsating or undulating movement of the microtiter plate.

The device described here is suitable for automatic actuation, provides high operational reliability, and has a space-saving and simple design.

The invention claimed is:

1. A tempering block module for a device for thermal treatment of samples, the tempering block module comprising:

a tempering block;

a tempering element;

a heat sink;

an ejection mechanism configured to lift reaction vessels disposed on the tempering block from the tempering block and including a first ejection plunger and a second ejection plunger, wherein the first ejection plunger and the second ejection plunger are movably mounted in the tempering block module perpendicular to a plane in which the tempering block is arranged such that the first ejection plunger and the second ejection plunger are movable from a retracted first position within the tempering block module to a second position extended out of the tempering block module;

a first plunger drive operatively connected to the first ejection plunger and configured to drive movement of the first ejection plunger from the first position to the second position or from the second position to the first position; and a second plunger drive operatively connected to the second ejection plunger and configured to drive movement of the second ejection plunger from the first position to the second position or from the second position to the first position, wherein the first plunger drive and the second plunger drive are each driven and controlled independently, thereby enabling different force, different speed and/or different timing therebetween.

2. The tempering block module of claim 1, further comprising a plurality of ejection plungers and a plurality of plunger drives, one plunger drive per ejection plunger, such that each plunger drive is operatively connected to one of the plurality of ejection plungers and configured to drive the movement of the corresponding ejection plunger from the first position to the second position and from the second position to the first position.

3. The tempering block module of claim 1, wherein the first and second ejection plungers are arranged on a periphery of the tempering block.

4. The tempering block module of claim 1, wherein the first and second ejection plungers are mounted directly or indirectly on the heat sink via one or more further components.

5. The tempering block module of claim 1, wherein the first and second plunger drives are embodied as linear motors.

6. A device for thermal treatment of samples, the device comprising:

a base unit including a receiving region configured for receiving one or more reaction vessels;

a tempering block module disposed in the base unit, the tempering block module comprising:

a tempering block;

an ejection mechanism configured to lift reaction vessels disposed on the tempering block from the tempering block and including a first ejection plunger and a second ejection plunger, wherein the first ejection plunger and the second ejection plunger are movably mounted in the tempering block module perpendicular to a plane in which the tempering block is arranged such that the first ejection plunger and the second ejection plunger are movable from a retracted first position within the tempering block module to a second position extended out of the tempering block module;

a first plunger drive operatively connected to the first ejection plunger and configured to drive movement of the first ejection plunger from the first position to the second position or from the second position to the first position; and a second plunger drive operatively connected to the second ejection plunger and configured to drive movement of the second ejection plunger from the first position to the second position or from the second position to the first position; and a cover configured to close off the receiving region and to be moved from an open third position to a closed fourth position, wherein the cover includes a cover plate having a front surface, wherein the front surface configured to apply a pressing force against reaction vessels disposed on the tempering block when the cover is in the fourth position, wherein the first plunger drive and the second plunger drive are each driven and controlled independently, thereby enabling different force, different speed and/or different timing therebetween.

7. The device of claim 6, further comprising:

at least one connecting element connected to the cover; and a cover drive disposed in the base unit and coupled to the at least one connecting element as to drive the movement of the cover from the third position to the fourth position and/or from the fourth position to the third position, wherein the cover drive is coupled to the at least one connecting element such that, during the movement from the third position to the fourth position, the cover with the cover plate, in a first movement segment, is initially moved from the third position into a fifth position in which the front surface of the cover plate extends parallel to and spaced from the tempering block, and that the cover with the cover plate, in a subsequent second movement segment, is moved from the fifth position in a direction of a shared normal of the front surface and a plane in which the tempering block is arranged, the second movement segment continuing toward the receiving region of the base unit until the cover has reached the fourth position.

8. The device of claim 7, wherein the cover drive is adjustable and/or controllable for adjusting the pressing force applied perpendicularly on the front surface of the cover plate and applied to the cover and the cover plate via the connecting elements during the second movement segment.

9. The device of claim 7, further comprising a drive control connected or connectable to the first and second plunger drives of the tempering block module and configured to control the first and second plunger drives independently of one another based on a specification by a user or a higher-level control connected to the drive control.

10. The device of claim 9, wherein the cover drive includes an electric motor, and wherein the drive control is configured to adjust the pressing force that the cover drive exerts on the cover and the cover plate via at least one connecting element.

11. The device of claim 9, wherein the drive control is configured, in a first operating mode, to control the first and second plunger drives such that the first and second ejection plungers are moved to the second position and/or are moved back to the first position at different times.

12. The device of claim 9, wherein the drive control is configured, in a second operating mode, to drive the first and second plunger drives such that the first and second ejection plungers are moved synchronously to the first position and/or the second position.

13. The device of claim 9, wherein the drive control is configured to control the cover drive and the first and second plunger drives so as to be coordinated with each other such that, when the cover is moved from the fourth position to the first position, the first and second ejection plungers are moved synchronously or successively from the first position to the second position.

14. A method for removing a microtiter plate from a tempering block of a device for thermal treatment of samples, the method comprising:

providing the device for the thermal treatment of samples, the device including:

a base unit;

a tempering block module, including the tempering block, disposed in the base unit;

moving a cover, including a cover plate and configured to close the base unit, along a first movement segment from a closed position, in which a front surface of the cover plate exerts a pressing force against the microtiter plate, into an intermediate position in which the front surface of the cover plate extends parallel to and is spaced from the microtiter plate;

subsequently, moving the cover to an open position; and moving a first ejection plunger and a second ejection plunger, which are movably mounted in the tempering block module perpendicular to a plane in which the tempering block is arranged, from a first position retracted into the tempering block module to a second position extended from the tempering block module, using a first plunger drive to move the first ejection plunger and using a second plunger drive to move the second ejection plunger, wherein the first ejection plunger and second ejection plunger strike against an edge of the microtiter plate during movement and lift the microtiter plate from the tempering block, wherein the first plunger drive and the second plunger drive are each driven and controlled independently, thereby enabling different force, different speed and/or different timing therebetween.

15. The method of claim 14, wherein the movement of the cover and the movement of the first ejection plunger and second ejection plunger occur simultaneously and synchronously such that the cover plate rests against the microtiter plate until the first and second ejection plungers have reached the second position.

16. The method of claim 14, wherein the movement of the cover is effected using a cover drive controlled by a drive control, and wherein the first and the second plunger drives are likewise controlled by the drive control.

* * * * *